US009464399B2

(12) United States Patent
Melancon

(10) Patent No.: US 9,464,399 B2
(45) Date of Patent: Oct. 11, 2016

(54) PILE CUTTER

(71) Applicant: Paige Melancon, Broussard, LA (US)

(72) Inventor: Paige Melancon, Broussard, LA (US)

(73) Assignee: ATS Smart Solutions, LLC, Broussard, LA (US)

( * ) Notice: Subject to any disclaimer, the term of this patent is extended or adjusted under 35 U.S.C. 154(b) by 0 days.

(21) Appl. No.: 14/607,975

(22) Filed: Jan. 28, 2015

(65) Prior Publication Data

US 2015/0211202 A1 Jul. 30, 2015

Related U.S. Application Data

(60) Provisional application No. 61/932,292, filed on Jan. 28, 2014.

(51) Int. Cl.
*B24C 1/04* (2006.01)
*E02D 9/04* (2006.01)

(52) U.S. Cl.
CPC ..... *E02D 9/04* (2013.01); *B24C 1/045* (2013.01)

(58) Field of Classification Search
CPC ..... B24C 1/04; B24C 1/045; E02D 9/04
USPC ..... 451/76, 75, 102, 38–40; 125/13.01
See application file for complete search history.

(56) References Cited

U.S. PATENT DOCUMENTS 3,216,295 A 11/1965 Gill
3,293,963 A 12/1966 Carroll et al.
3,338,305 A * 8/1967 Pittman ..... E21B 29/12 166/298
3,859,877 A 1/1975 Sherer et al.
4,856,938 A * 8/1989 Kuehn ..... E21B 7/124 166/55
5,381,631 A * 1/1995 Raghavan ..... B24C 1/045 166/298
5,852,277 A 12/1998 Gustafson
5,974,924 A 11/1999 Schartinger et al.
6,508,975 B1 1/2003 Godlewski et al.
6,947,819 B2 9/2005 Nelson et al.
7,434,633 B2 * 10/2008 Lynde ..... E21B 29/005 166/55.8
7,540,327 B2 * 6/2009 Billingham ..... E21B 41/00 166/223
7,575,056 B2 8/2009 Fuhst et al.
8,200,074 B1 6/2012 Melanco
8,820,396 B2 * 9/2014 Cumby ..... E21B 29/005 166/55
2011/0290091 A1 12/2011 Clark, II et al.
2013/0126168 A1 5/2013 Perio

OTHER PUBLICATIONS

Insite Pacific, United States.
UEI CLM 100, Melarose, MA.
Ac-cess, Minature Colour Camera, United Kingdom, Feb. 28, 2014.
(Continued)

*Primary Examiner* — Robert Rose

(57) ABSTRACT

A remotely controlled pile cutter for insertion to a desired position within a tubular piling comprises an insertion cable attached to a lifting sub, radially extendable centralizer arms, an extendable rotatable cutter, a camera, and monitors and sensors in communication with a control panel and computer processor where information and control signals are received and generated. The radially extending centralizer arms hold the pile cutter in place at the internal piling wall. Radial extension of the rotatable cutter positions a fluid nozzle to direct high pressure cutting fluid against the internal piling wall as the cutter is rotated around the internal piling wall to sever the piling. The location and position of the rotatable cutter, the fluid steam, and the physical properties of the cutter environment may be continually and remotely monitored at the control panel.

13 Claims, 10 Drawing Sheets

(56) References Cited

OTHER PUBLICATIONS

Newell Electronics, RPE-PV. Columbus, Ohio, Jun. 20, 2014.
Pro Sense, SPT25 Series, Apr. 16, 2014.
High-Quality, Rugged Encoders, Oct. 22, 2014.
Measurement Specialities, DC-EC Series, Jan. 2014.
BEI Sensors, France.
Dynapar, Rotary Encoder, Gurnee, IL, 2011.
Encoder Products Company, Jun. 20, 2014.
Hydac Flow Series.
T3 Innovation, Snap Shot, Camarillo, CA.
Open Access Sensors, Distance and Cable Length Measurement System, Hernandez, 2009.

* cited by examiner

PILE CUTTER

PRIORITY

This application claims priority to U.S. provisional application Ser. No. 61/932,292 filed Jan. 28, 2014 entitled "Pile Cutter", the entire content of which is incorporated by reference.

FIELD OF TOE INVENTION

The inventions relates to the field of pipe piling disassembly and removal and, more particularly, to a remotely controlled pile cutter provided with monitoring systems and controls to facilitate the controlled cutting of piling at a desired depth below mudline of a body of water.

BACKGROUND OF THE INVENTION

Offshore oil and gas drilling and production platforms are typically supported upon a network of tubular piles. Each of the tubular piles will typically have an upper end that supports the platform structure and lower end driven to a desired depth below the water bottom frequently called tire mudline. When oil and gas drilling and production activities cease and the platforms are no longer needed, regulations may require that the drilling and production platforms be removed and the tubular piles supporting the platforms to be cut at a specified vertical position or depth below the mudline. Each pile is typically cut with an internal cutter inserted into the tubular pile. This internal cutter allows the pile to be severed and removed without having to dig into the surface mud to facilitate the pile cutting.

Because the piles may be bent, damaged, or driven at an angle it may be difficult to determine the vertical position or depth below the mudline where a cut is to be made or hamper the cutting process because of difficulty in locating and securely positioning a cutter to make a cut on the pile. Other conditions such as impaired visibility due to muddy or murky seawater may hamper or prolong the cutting process by making it difficult, if not impossible, to determine if a cut is being accurately made in a manner sufficient to sever the pile. The cutters now utilized in the industry do not adequately address these difficulties.

SUMMARY OF THE INVENTION

The present invention provides a pile cutter for cutting platform piling; specifically hollow tubular piling having a top end that extends above a water bottom, mudline and a bottom end that extends below water bottom mudline. The pile cutter will allow a user to readily determine the vertical position or depth of the pile cutter within a hollow tubular pile and its depth and position with the pile with respect to the mudline. The pile cutter of the present invention will allow a user to readily locate, fix, and stabilize the position of the cutter within the tubular pile so the pile can be cut internally at a specified predetermined vertical position.

The pile cutter is comprised of longitudinally disposed upper and lower tubular centralizer housings. These centralizer housings contain a plurality of pivotally attached centralizer arms. The centralizer arms are mounted within the centralizer housings so they may be radially extended and retracted from the centralizer housings by extending and retracting the piston of a hydraulic cylinder.

Positioned within the lower centralizer housing is a motor assembly comprised of a motor and shaft, a gear box, and bearing assembly. The motor assembly provides 360° rotation about the Longitudinal axis of a longitudinally disposed tubular cutter swing carriage housing that is rotatably mounted with the motor assembly below the lower centralizer housing.

The cutter swing carriage housing contains a cutter swing carriage plate that supports a nozzle of a hydraulic cutter. The cutter swing carriage plate is pivotally mounted on swing carriage plate support arms to swing radially outward through a carriage plate window in the cutter swing carriage housing also by extending and retracting the piston of a hydraulic cylinder.

This allows the cutter swing carriage plate that supports a nozzle of a hydraulic cutter to be extended and retracted from within the cutter swing carriage housing and pivotally positioned as desired.

A lifting sub is attached to the upper tubular centralizer housing so that a lifting wire or cable may be attached to the lifting sub to allow the pile cutter to be lifted into and out of the hollow tubular pile.

A fluid control system comprising pumps, valves, pressure, gauges is provided at the surface, and hydraulic hoses are brought from fluid control system to the hydraulic cylinders of the centralizers and the cutter swing carriage plate of the pile cutter so the pile cutter may be positioned as desired within the pile to be cut. Pressure sensors, depth sensors, motor rotation sensors and encoders, motion sensor, and at least one camera positioned near the cutter with associated wiring, hoses, or necessary umbilical control links may be provided to generate and deliver information signals to a control panel to allow monitoring and viewing of the cut location and the progress made during the pile cutting. Control signals from the control panel may be delivered to the various motors, pumps, and cylinders to adjust the pile cutter in the Getting process if necessary.

The cutter will be a hydraulic cutter or water jet utilizing an abrasive hydraulic cutting fluid delivered from a surface hydraulic pump. Depending upon the types of piles and the working conditions, other types of cutters may be utilized such as rotating wire cutters, carbide saws, air cutters, air and abrasive cutters, or laser cutters.

Both pneumatic and hydraulic cylinders may be suitable for the cylinder and piston mechanism used to extend and retract the centralizers and the cutter swing carriage plate and hydraulic cutter.

The motor used to rotate the cutter swing carriage housing will be a hydraulic motor but another suitable motor such as an electric motor may be utilized.

In use a cable is attached to the lifting sub of the pile cutter and the pile cutter is lowered to a desired position inside the pile to be cut. The position of the pile cutter inside the pile is monitored and determined by the pressure and depth sensors. In this manner the precise placement of the pile cutter within the pile may be determined.

Once the pile cutter is placed in a desired position, the centralizers are extended from the upper and lower centralizer housing to hold the pile cotter in place. The piston of the cylinder and piston mechanism of the cutter swing carrier plate is then extended to radially extend the cutter swing carriage plate and hydraulic cutter to a position against the interior of the pile where cutting may be commenced. Cutting fluid is pumped through the associated cutting fluid, hoses and through the cutter nozzle to effectuate the cutting action of the pile cutter. The motor assembly is engaged to rotate the cutter swing carriage housing about the longitudinal axis of the pile cutter as the pile is being cut. The rotation of the cutter swing carriage housing and the corresponding rotation of the cutter swing carriage plate and hydraulic cutter are monitored by sensors and encoders. A camera also generates pictures of the cutting progress during the cutting process.

All of the cutting parameters including air pressure, water pressure, water depth, centralizer cylinder and piston pressure, cutter location, cutter motor rotation, cutting fluid pressure and volume, cutter swing carriage housing and the corresponding rotation, of the cutter swing carriage plate and hydraulic cutter rotation, and camera images are monitored by control devices that generate signals to and from a surface control panel. In this manner an operator can determine how effective the cut is being made and its location below the water surface and the mudline. This data may be recorded and maintained for reporting purposes and for regulatory compliance.

DESCRIPTION OF THE EMBODIMENTS

Figure 1:
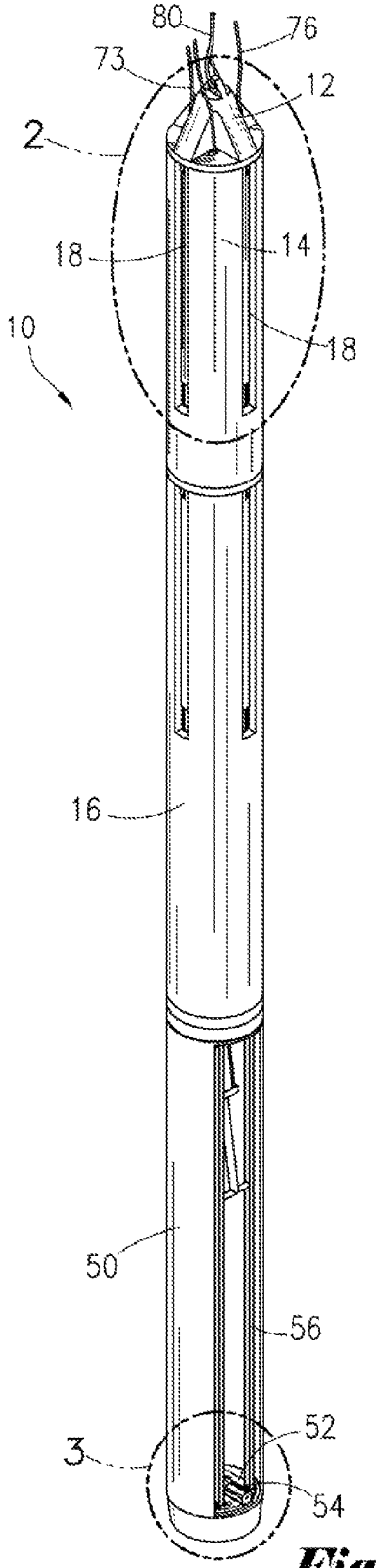
FIG. 1 is a perspective view of the pile cutter described herein in a closed position.
Figure 2:
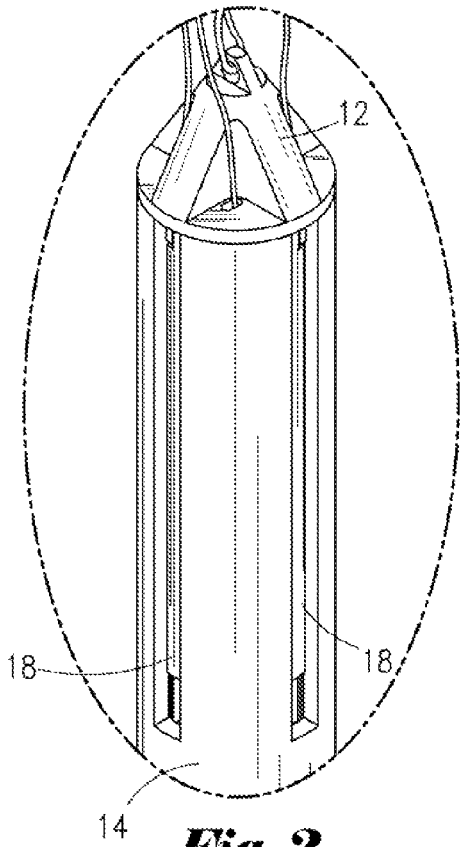
FIG. 2 is a perspective view of the lifting sub of the pile cutter shown in FIG. 1.
Figure 3:
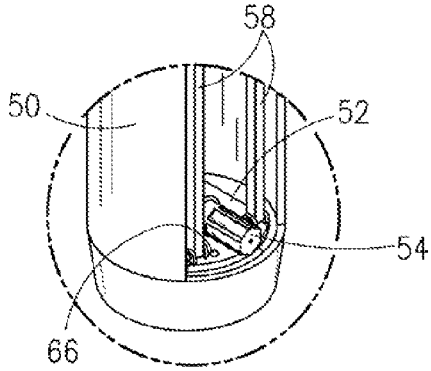
FIG. 3 is a perspective view of the hydraulic cutting section of the pile cutter shown in FIG. 1.
Figure 4:
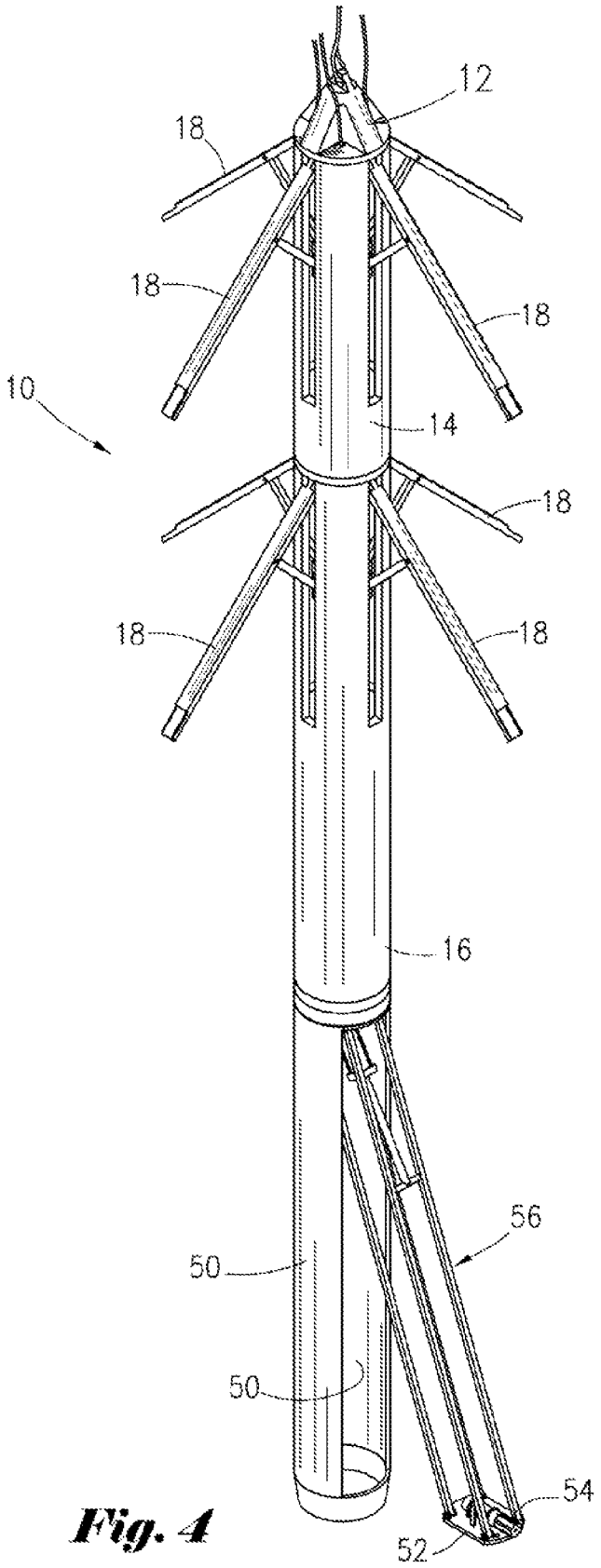
FIG. 4 is a perspective view of the pile cutter shown in FIG. 1 in an open position.

In considering the drawings and the description presented with this description, common features that are well established and do not bear upon points of novelty are omitted in the interest of descriptive clarity. Such omitted features may include threaded junctures, weld lines, sealing elements, gaskets, pins, fasteners, screws, and glued or brazed junctures. In some of the drawings the umbilical lines for cylinders and pistons, hydraulic fluids, sensors, and controls are also omitted for clarity.

Referring to now to the drawings, and more particularly to FIGS. 1-6, pile cutter (10) having a longitudinal axis (A) is comprised of a lifting sub (12) attached to an upper longitudinally disposed centralizer housing (14) between which is sandwiched a fixed centralizer hub (22). A lower longitudinally disposed tubular centralizer housing (16) is attached to the upper centralizer housing (16) between which is also sandwiched a fixed centralizer hub (22). A plurality of pivotally attached centralizer arms (18), each having a first end pivotally attached to said fixed centralizer hub (22) and a linearly distal second end, are distributed are radially around each centralizer housing (14) and (16).

Figure 5:
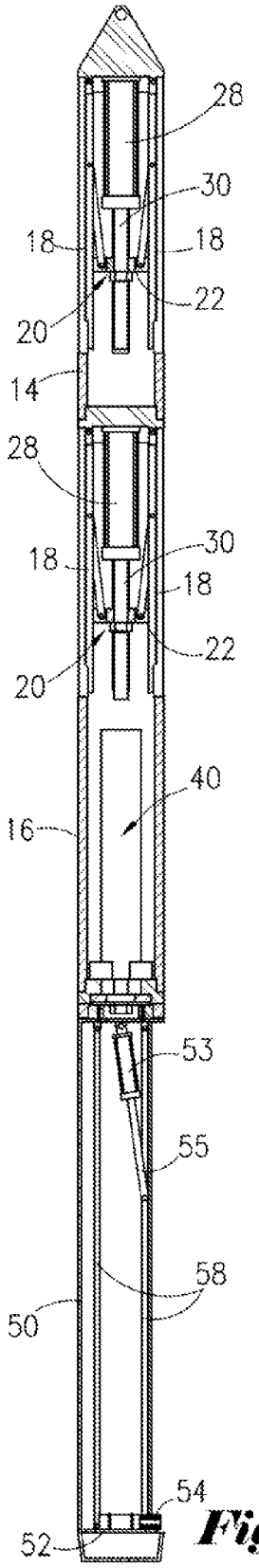
FIG. 5 is a cross-section detail view of the pile cutter shown in FIG. 1 in a closed position.
Figure 6:
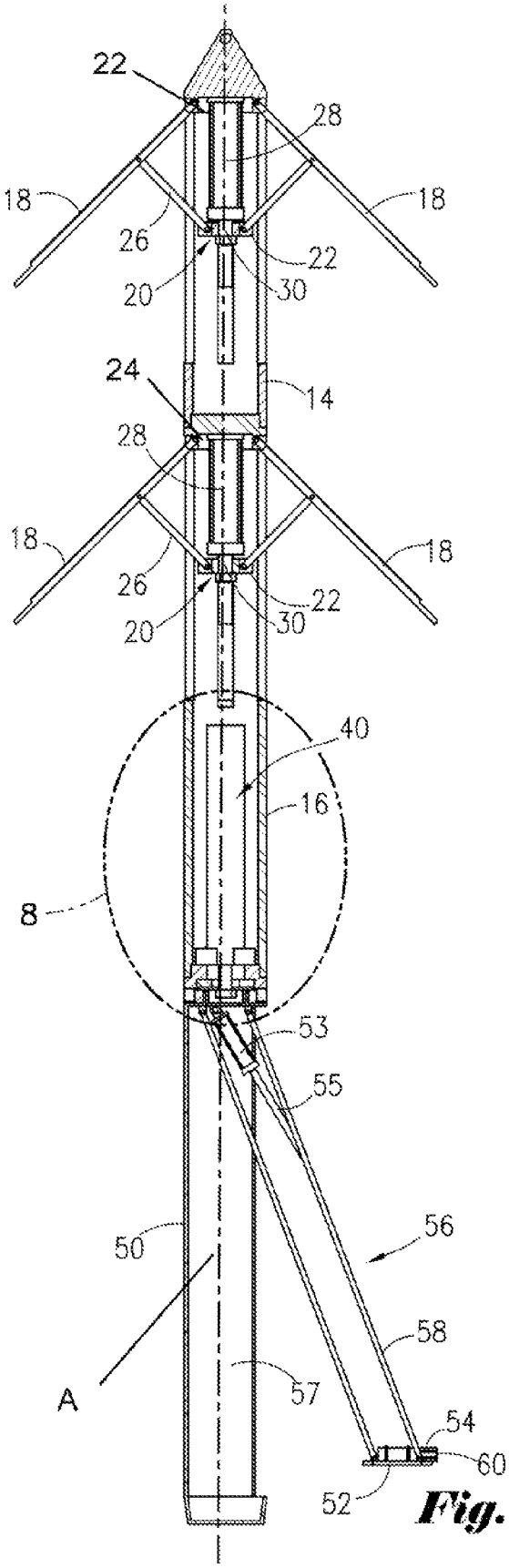
FIG. 6 is a cross-section detail view of the pile cutter shown in FIG. 1 in an open position.
Figure 7:
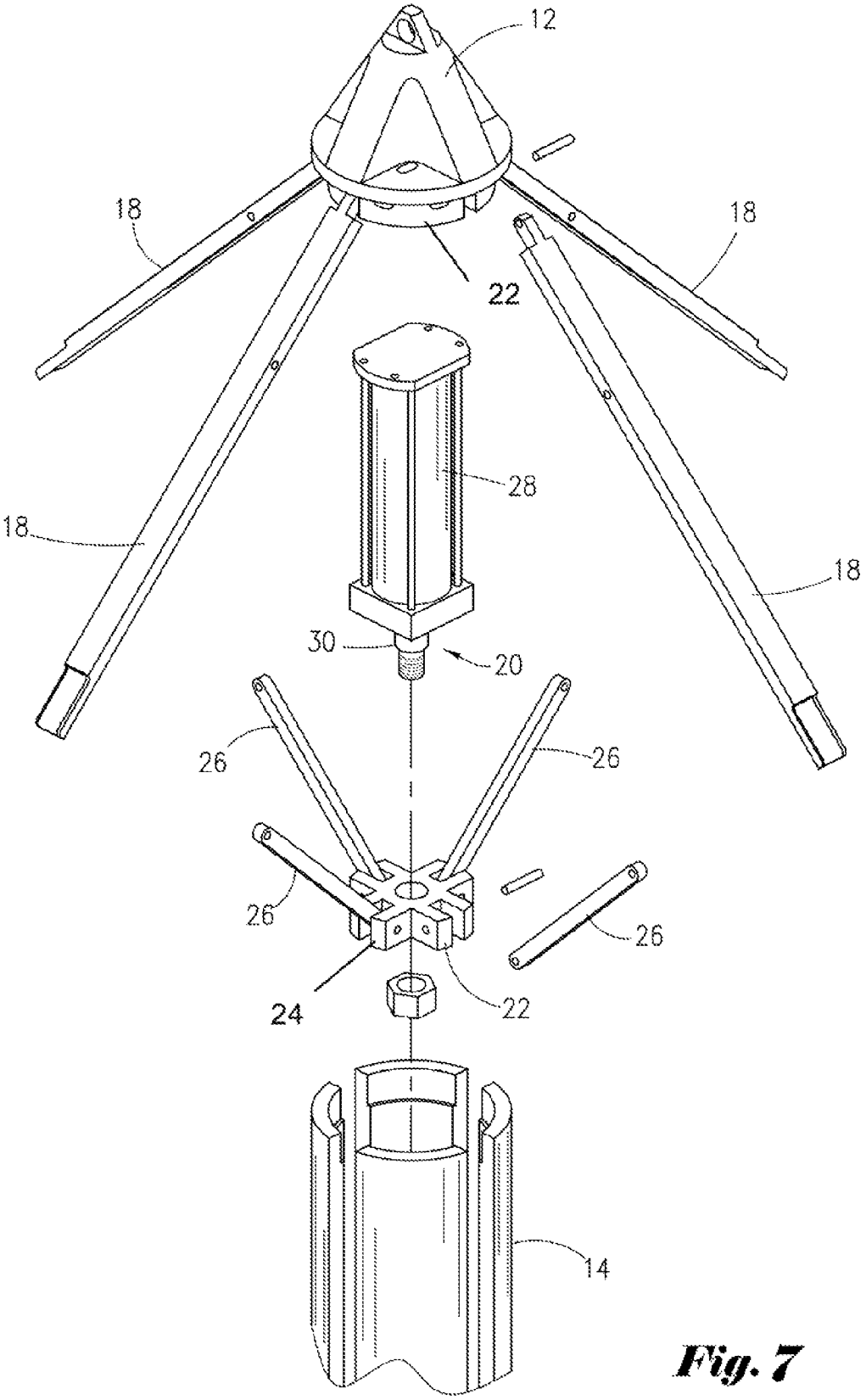
FIG. 7 is an exploded detail view of the centralizer arms and centralizer piston rod and cylinder mechanisms of the pile cutter shown in FIG. 1.

The centralizer arms (18) are extendable and retractable radially from the upper and lower centralizer housings (14) and (16) by means of the centralizer piston rod and cylinder mechanisms (20) shown in FIGS. 5-7. Each centralizer piston rod and cylinder mechanism (20) is comprised of a cylinder (28) having an extendable and retractable piston rod (30). The cylinder (28) is oriented vertically to have a top end attached to the fixed centralizer hub (22) with the bottom end of the piston (30) attached to a traveling centralizer hub (24). Each centralizer arm (18) in each centralizer housing (14) and (16) has a first end pivotally attached to a fixed centralizer hub (22) and a second linearly distal free end. Each centralizer arm (18) has an associated centralizer support (26) having a first end pivotally attached to a selected point on centralizer arm (18) located between the first pivotally attached end and the free second end of each centralizer support arm (18). Each centralizer support (26) has a second end pivotally attached to a sliding centralizer hub (24).

Extension and retraction of the rod (30) will raise or lower the sliding centralizer hub (24) with respect to the fixed centralizer hub (22) and thereby pivot, each centralizer arm (18) on its corresponding centralizer support (26) to correspondingly radially retract and extend the centralizer arms (18) from the centralizer housings (14) and (16). The extendable and retractable piston rod (30) may be hydraulic-ally or pneumatically actuated from the cylinder (28).

A motor assembly (40) is positioned in the lower centralizer housing (16). A rotatable cutter swing carriage housing (50) having a cutter swing carriage plate extension assembly (56) with a radially extendable cutter swing carriage plate (52) that supports a hydraulic cutter (54) is attached to the motor assembly 40 to allow rotation of the cutter swing carriage housing (50) about the longitudinal axis (A) of the pile cutter (10).

Figure 8:
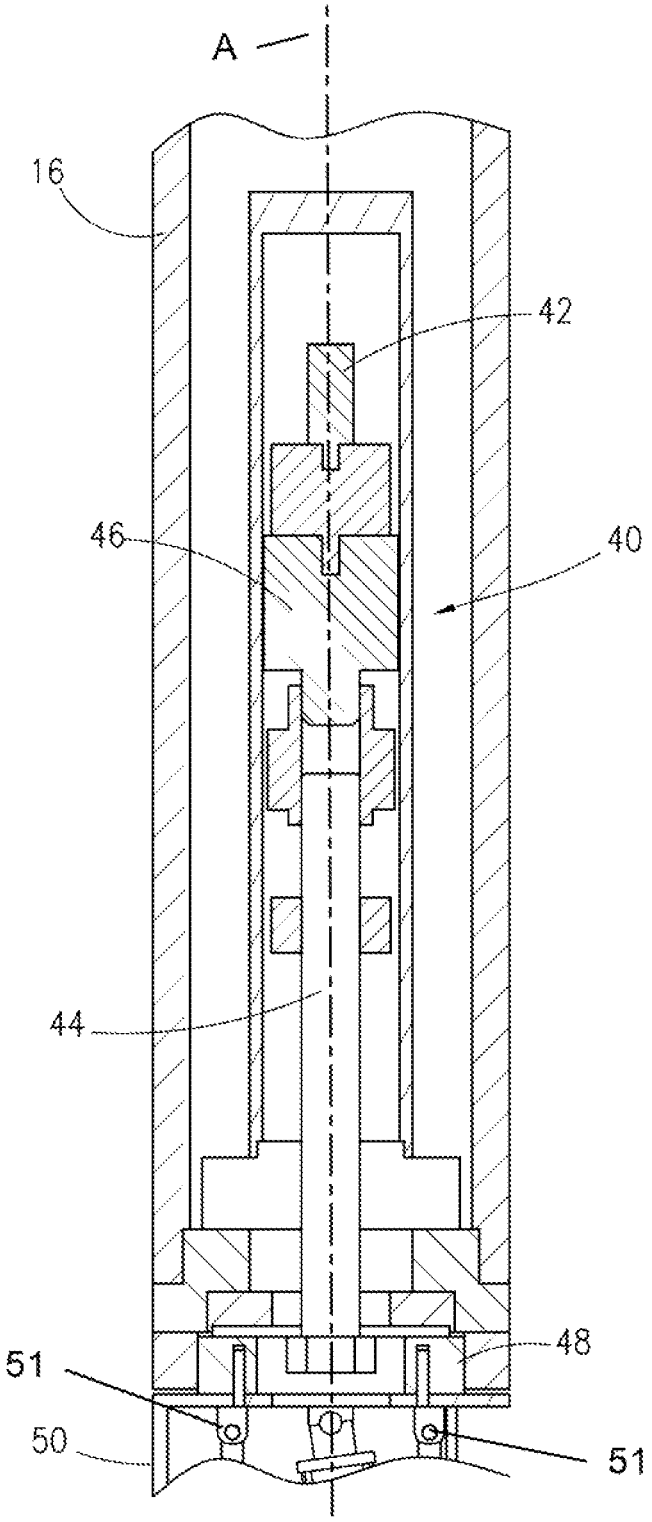
FIG. 8 is a cross-section detail view of the motor assembly of the pile cutter shown in FIG. 1.

Motor assembly (40), as shown in FIG. 8, is positioned within the lower centralizer housing (16) and is comprised of a motor (42), motor shaft (44), gear box (46), and bearing assembly (48). The bearing assembly (48) is positioned at the base of the lower centralizer housing (16) and the cutter swing carriage housing (50) is attached to the motor shaft (44) so that the cutter swing carriage housing (50) may be rotated on the bearing assembly (48) by rotation of the motor shaft (44) about the longitudinal axis (A) of the pile cutter (10). The gear box (46) will be a system of planetary gears to provide 360° rotation of the longitudinally disposed tubular cutter swing carriage housing (50) about longitudinal axis of the pile cutter (10). The motor (42) will be a hydraulic motor but other suitable motors such as an electric motor may be utilized.

Figure 9:
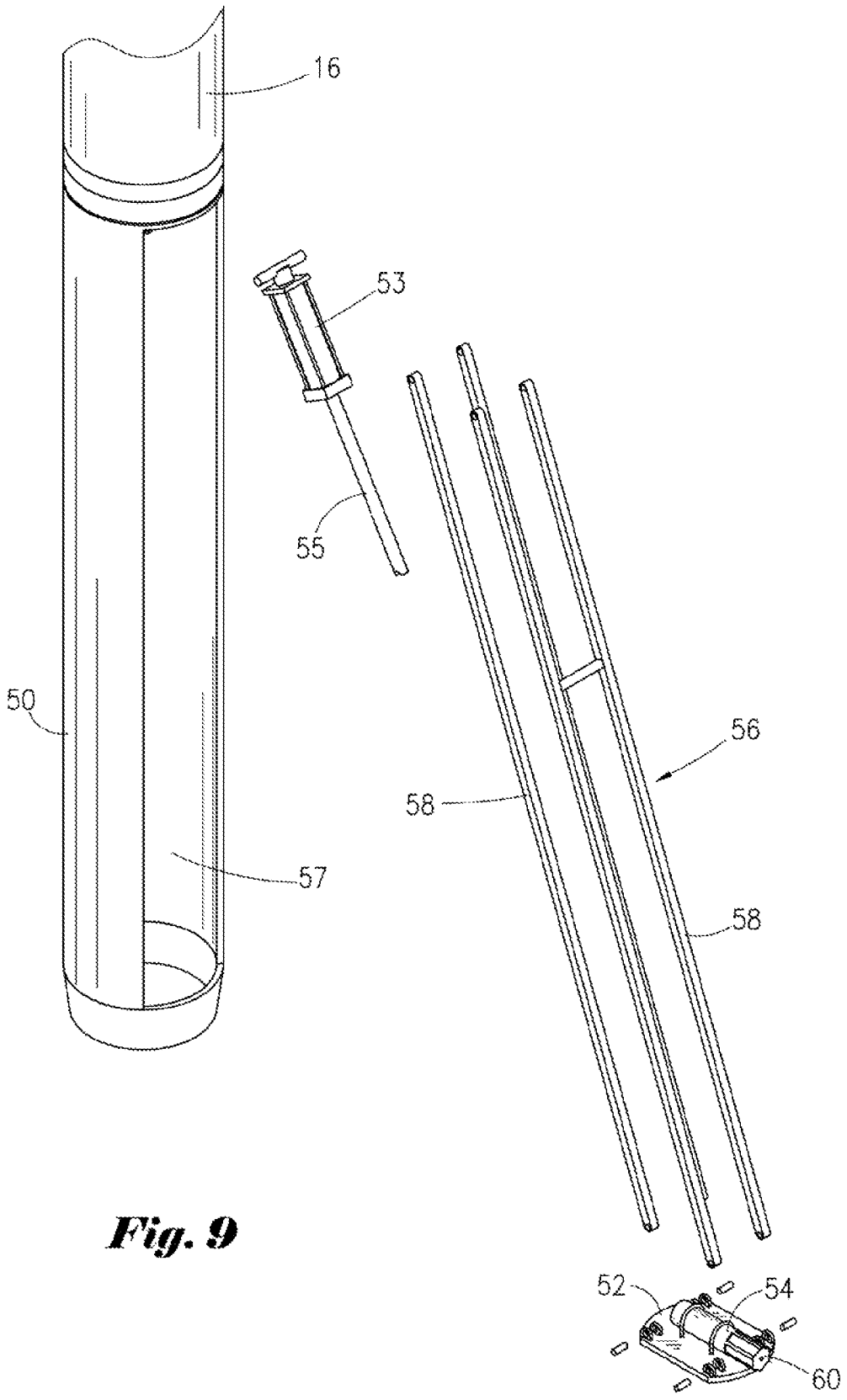
FIG. 9 is an exploded detail view of the hydraulic cutting section of the pile cutter shown in FIG. 1.

An explode view of the assembly of the cutter swing carriage housing (50), cutter swing carriage plate (52), and cutter swing carriage plate extension assembly (56) is shown in FIG. 9. The cutter swing carriage plate (52) is radially extendable from the cutter swing carriage housing (50) with cutter swing carriage plate extension assembly (56). The cutter swing carriage plate extension assembly (56) is comprised of cutter plate support arms (58) pivotally attached to pivots (51) on the cutter swing carriage housing (50) and the cutter swing carriage plate (52). A pivotally attached cylinder (53) having an extendable and retractable piston rod (55)

is attached between the carriage housing (50) and the cutter plate support, arms (58). The extendable and retractable piston rod (55) may be hydraulically or pneumatically actuated from the cylinder (53). Extension and retraction of the rod (55) will raise or lower the cutter plate support arms (58) and radially extend and retract the cutter swing carriage plate (52) from the cutter swing carriage housing (50). The cutter swing carriage housing (50) is provided with a cutter swing carriage plate recess (57) so the cutter swing carriage plate (52) and hydraulic cutter (54) may be radially disposed from the cutter swing carriage housing (50), pivotally positioned as desired, and then angularly retracted back through the cutter swing carriage plate recess (57) into the cutter swing carriage housing (50) with the swing-carriage arms (58) and the pivotally attached cylinder (53).

Figure 10:
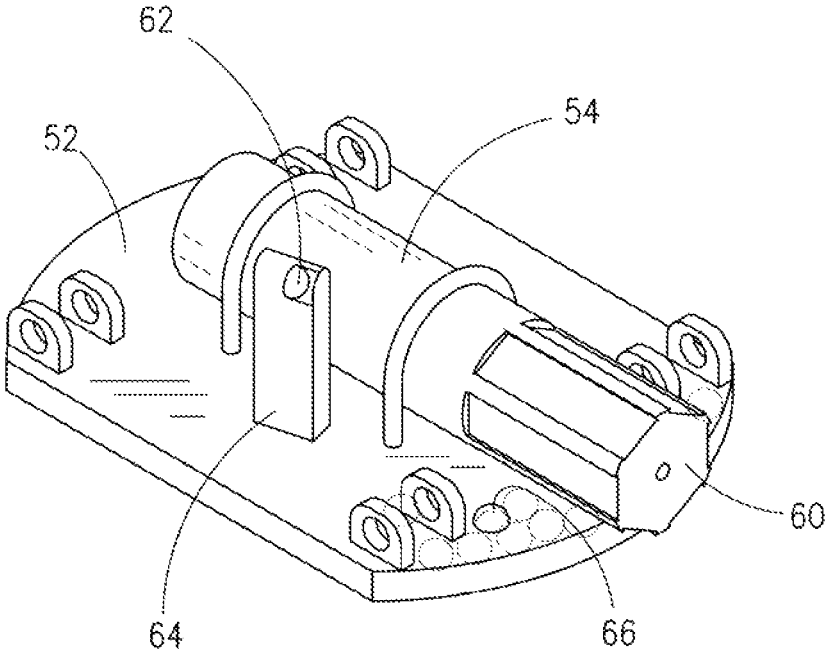
FIG. 10 is a perspective view of an alternate embodiment of the pile cutter shown in FIG. 1 having an attached camera.

The hydraulic cutter (54) is fitted with a nozzle (60) so a concentrated fluid cutting stream may be focused on the interior of the pile to be cut. The fluid cutting stream may be augmented with abrasives to facilitate cutting. The nozzle (60) of the cutter (54) is removable and replaceable as may be necessary. Nozzle (60) may be an abrasive water jet nozzle configured with a mixing tube for receiving a flow of abrasives in the fluid cutting stream. A garnet abrasive such as hard rock garnet abrasive will be utilized as the fluid abrasive. Other abrasives such as olivine or alluvial garnet may also be utilized depending upon the piling type and other cutting parameters As shown in FIG. 10, a camera (62), such as a miniaturized camera, may be placed on the cutter swing carriage plate (52) of the pile cutter (10) and positioned as desired in proximity to the hydraulic cutter (54). The camera (62) may be placing in protective chamber (64) as shown to protect the lens from grit or mud produced during pile cutting if required. A lighting system (66) may be provided to allow a user to view and monitor the cut location and cutting progress. A lighting system (66) comprised of a plurality of high intensity LED lights would be suitable. The light system (66) may also be incorporated into the camera (62).

Figure 11:
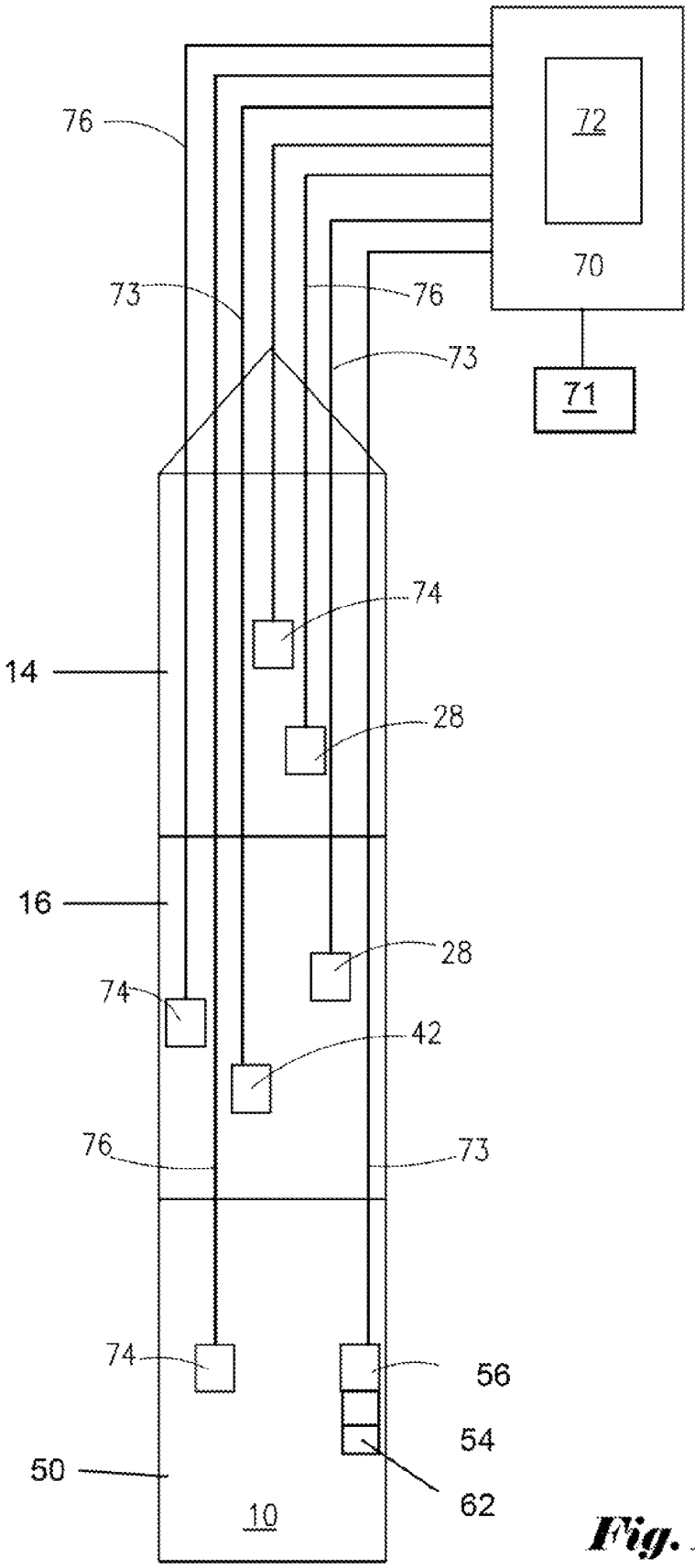
FIG. 11 is a diagram drawing of the pile cutter shown in FIG. 1 and its control system.

FIG. 11 shows a diagram drawing of the pile cutter (10) and its control system (70). The control system (70) of pile cutter (10) is a comprised of control panel (72), a plurality of monitors and sensors, collectively referred to as monitors and sensors (74), and a plurality-associated information umbilicals (76). The monitors and sensors (74) monitor and record the environmental conditions around pile cutter (10) and the physical parameters and position of the pile cutter (10) and its components.

The monitors and sensors (74) may include pressure sensors and TDR (time domain reflextometry) cable length measurement systems to determine the depth the pile cutter (10) within the pile to be cut, linear variable differential transformers (LVDT) sensors, proximity sensors, and motion sensors to determine the extended or retracted position of piston rod (30) with respect to cylinder (28) and the extension and retraction of centralizer arms (18), temperature sensors and pressure sensors to determine the water temperature and pressure where the pile cutter (10) is located, rotary variable differential transformers (RVDT), rotary speed sensors and rotation sensors to determine the rate of rotation and the position of the motor shaft (44) and the position of the associated cutter swing carriage housing (50), linear variable differential transformers (LVDT) sensors, proximity sensors, and motion sensors to determine the extension of the cutter swing carriage plate extension assembly (56) and correspondingly the cutter swing carriage plate (52), fluid flow sensors and pressure sensors to monitor the flow and fluid cutting stream from the nozzle (60) of the cutter (54), digital images and video signals from camera (62) to monitor the pile cutting, and sensor to monitor other parameters that might be necessary to precision cutting of a pile, information signals reflecting the environmental conditions and the physical parameters and position of the pile cutter (10) and its components are generated by the monitors and sensors (74) and transmitted to the control panel (72) through the information umbilicals (76).

The control system (70) also has a plurality of pumps, valves, pressure gauges, associated flow lines, cutting fluid supply hoses, wiring, electrical components, control lines, and the like, all collectively referred to as power, supply, or control, umbilicals (73), that are used to remotely monitor and control the cylinders, motors, camera, and cutter used for operation of the pile cutter (10). The information signals transmitted to the control panel (72) may be reviewed and assessed manually by corresponding digital or analog recorders, indicators, and gauges provided as part of control panel (72) or the information signals may be reviewed and assessed by a computer processor (71) associated with control panel (72). Corresponding control switches, valves, and relays provided as part of control system (70) may then generate and direct control signals delivered from the control panel (72) through the power, supply, or control umbilicals (73) to remotely control the components of the pile cutter (10). The corresponding control switches, valves, and relays may be manipulated, manually from control panel (72) to deliver control signals through power, supply, or control umbilicals (73) or control signals may be delivered by the associated computer processor (71).

Figure 12:
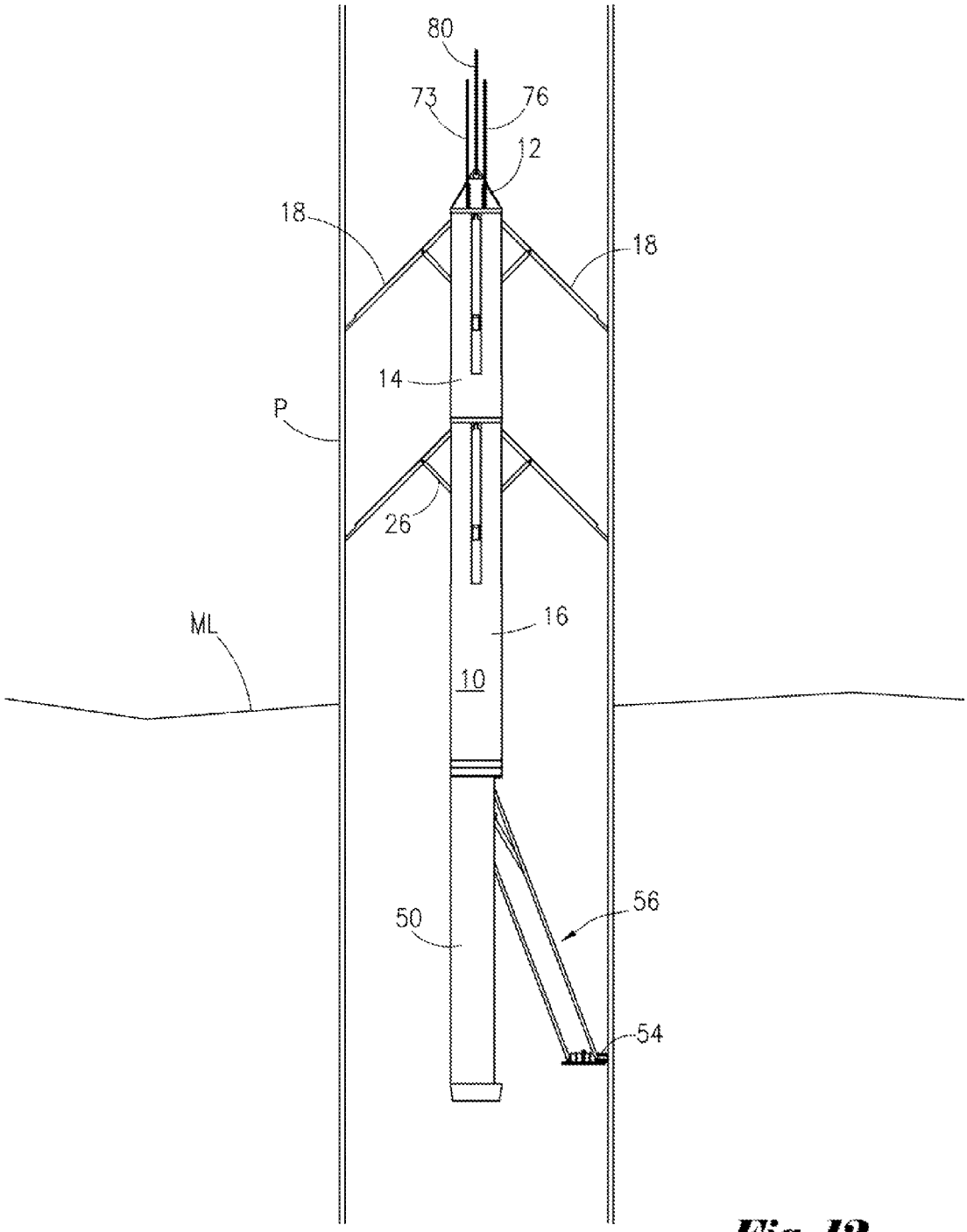
FIG. 12 is a longitudinal cross-section view of a pile to be cut showing the method of placement of the pile cutter shown in FIG. 1 within the pile by means of an inserting cable.

In use, as shown in FIG. 12, cable (80) is attached to the lifting sub (12) of pile cutter (10) so the pile cutter (10) may be suspended from cable (80) and then lowered to a desired position inside a hollow pile (P) with a hoist or other support system. The information umbilicals (76) in communication with the end monitors and sensors (74) and power, supply, or control umbilicals (73) in communication with control panel (72) also extend along cable (80) as the pile cutter (10) is lowered to the desired position. Typically the pile cutter (10) is lowered to a position within the pile (P) that is below the mudline (ML). The information signals generated by monitors and sensors (74) and then delivered through information umbilicals (76) to control panel (72) allow the control system (70) to determine the position of the pile cutter (10) inside the pile (P) and remotely adjust the position of the pile cutter (10) precise placement of the nozzle (60) of the cutter (54) at the desired selection location within the pile (P).

Once the pile cutter (10) is placed in a desired location, control signals are generated by the control system (70) through power, supply, or control umbilicals (73) to extend the piston (30) from cylinder (28) to extend centralizer arms (18) from the upper and lower centralizer housings (14) and (16) to hold the pile cutter (10) in place within the pile (P). Monitors and sensors (74) will confirm the extension and placement of the centralizers (18). Control signals are then generated from the control system (70) through power, supply, or control umbilicals (73) to extend the piston rod (55) of cylinder (53) of the cutter swing carriage plate extension assembly (56) to radially extend the cutter swing carriage plate (52) and hydraulic cutter (54) from the cutter swing carriage housing (50) to a position against the interior wall of the pile (P). Monitors and sensors (74) will confirm the extension and placement of the cutter swing carriage plate (52) and the hydraulic cutter (54) and nozzle (60). When the hydraulic cutter (54) is positioned as desired, pile cutting may be commenced.

Control signals are then generated from the control system (70) through power, supply, or control umbilicals (73) so that cutting fluid is then pumped to the hydraulic cotter (54) through, the associated umbilical (73) and through, the cutter nozzle (60) of cutter (54) to create a high pressure fluid stream to provide the cutting action of the pile cutter (10). The motor assembly (40) is then engaged to rotate the cutter swing carriage housing (50) about the longitudinal axis of the pile cutter (10) as the pile (P) is being cut from the pile interior outward.

The 360° rotation of the cutter swing carriage housing (50) and the corresponding rotation of the cutter swing carriage plate (52) and hydraulic cutter (54) about the longitudinal axis of the pile cutter (0.10) is monitored by monitors and sensors (74) and information signals are generated and delivered to the control panel 172) through information umbilicals (76) to confirm the rotational position of the cutter swing carrier plate (52). Camera (62) may also be employed to generate image signals through information umbilicals (76) to the control panel (72) during the cutting process to confirm and progress and quality of the cut.

Adjustments in the rate of rotation of cutter swing carriage housing (50) and correspondingly the cutter swing carriage plate (52), the fluid cutting stream from the nozzle (60), the images from the camera (62), the position of the position of centralizer arms (IS), or other components of the pile cutter (10) may be made from control signals generated from control system (70) and delivered through umbilicals (73) to the desired component. The control signals may be generated manually from control panel (72) and by the associated computer processor (71).

Use of the pile cutter (10) in the described manner allows an operator to remotely locate the pile cutter (10) within the pile (P), the position of hydraulic cutter (54); and whether the pile (P) will be cut the desired position below the water surface and the mudline (ML). Use of the pile cutter (10) in the described manner also allows an operator to remotely control the cutter (10) to regulate the quality of the cut as the cut is being made from within, the pipe (P).

The control panel (72) and computer processor (71) may also electronically record and store the data generated during pile cutting. The stored date may then be recovered, for future use is setting parameters for controlling and using the pile cotter (10), for reporting purposes, and for regulatory compliance.

Figure 13:
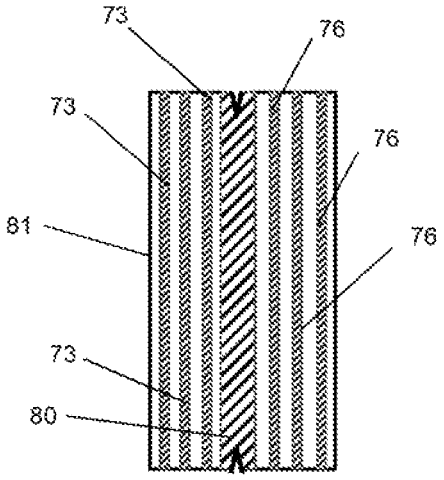
FIG. 13 is a schematic cross-section view of the insertion cable, information umbilicals, and power, supply, or control umbilicals encased in sheathing.

FIG. 13 is a schematic cross-section view of cable (80), information umbilicals (76), and power, supply, or control umbilicals (73) encased in a jacket or sheathing (81). The sheathing (81) will be a flexible material such as a plastic or polymer material thought another flexible sheathing material may be utilized. Sheathing (81) will protect the information umbilicals (76) and power, supply, or control umbilicals (73) from damage when the pipe cutter (10) is lowered into and out of the tubular pile (P).

It is understand that the rotational, angular, linear, and positional measurements obtained by use of the apparatus and methods described herein will be subject to reasonable construction tolerances and practices. It is also understood that the rotational, angular, linear, and positional measurements obtained by using the apparatus and methods described will be subject to the tolerances and limitations of the measuring, monitor, transmission equipment provided by the manufacturers and suppliers of the individual equipment and other components obtained for use.

Applicant believes that a person of ordinary skill in the art will understand the apparatus and methods of use provided in the foregoing description. A person of ordinary skill in art will also understand that and it will be apparent that changes may be made in the form, construction and arrangement of the parts of pile cutter (10) without departing from the spirit and scope of the invention or sacrificing all of its material advantages. The form described is merely an exemplary embodiment of Applicant's invention.

I claim:

1. A pile cutter comprising:

(a) a longitudinally extending centralizer housing;

(b) a plurality of centralizer arms, said centralizer arms radially extendable and retractable from said centralizer housing;

(c) a cutter swing carriage housing;

(d) a motor mounted within said cutter swing carriage housing whereby said cutter swing carriage housing rotatable about the longitudinal axis of said longitudinally extending centralizer housing;

(e) a cutter swing carriage plate radially extendable and retractable from said cutter swing carriage housing;

(f) a hydraulic cutter mounted on said cutter swing carriage plate; and (g) a control system comprised of umbilicals whereby said centralizer arms, said motor, and said cutter swing carriage plate may be remotely controlled.

2. The pile cutter recited in claim 1 wherein said motor is a hydraulic motor.

3. The pile cutter recited in claim 2 further comprising a camera mounted on said cutter swing carriage plate.

4. The pile cutter recited in claim 3 further comprising sensors generating signals whereby the rotational position of said hydraulic cutter about said longitudinally extending centralizer housing is determined.

5. The pile cutter recited in claim 4 wherein said hydraulic cutter includes an abrasive cutting fluids nozzle.

6. The pile cutter recited in claim 4 wherein said pile cutter is positioned to extend along the longitudinal axis of a longitudinally extending hollow pile having a first end and a second end.

7. The pile cutter as recited in claim 6 further comprising sensors generating information signals whereby the position of said hydraulic cutter with respect to said first end of said longitudinally extending hollow pile is determinable by said control system.

8. The pile cutter as recited in claim 7 further comprising:

(a) a control panel configured with said control system;

(b) sensors generating information signals to said control panel whereby a flow of hydraulic cutting fluid is delivered to said hydraulic cutter; and (c) wherein control signals are generated from said control panel whereby flow of said hydraulic cutting fluid is regulated.

9. The pile cutter recited in claim 8 further comprising:

(a) information umbilicals generating information signals to said control panel; and (b) power, supply, and control umbilicals delivering control signals generated by said control panel.

10. The pile cutter recited in claim 9 wherein said control signals are generated by a computer processor associated with said control system.

11. A pile cutter comprising:

(a) an attachment sub having an upper end attached to a support cable and a lower end;

(b) a first centralizer housing oriented to extend vertically along its longitudinal axis so as to provide a first centralizer housing upper end and a first centralizer housing lower end, said first centralizer housing upper end attached to said lower end of said attachment sub;

(c) a plurality of upper centralizer arms pivotally mounted within said first centralizer housing, said upper centralizer arms pivotally positionable radially outward from said first centralizer housing in response to extension and retraction of a piston in an upper centralizer piston rod and cylinder mechanism;

(d) a second centralizer housing oriented to extend vertically along its longitudinal axis so as to provide a second centralizer housing upper end and a second centralizer housing lower end, said second centralizer housing upper end attached to said first centralizer housing lower end;

(e) a plurality of lower centralizer arms pivotally mounted within said second centralizer housing, said lower centralizer arms pivotally positionable radially outward from said second centralizer housing in response to extension and retraction of a piston in a lower centralizer piston rod and cylinder mechanism;

(f) a hydraulic motor mounted within said second centralizer housing, said hydraulic motor having a shaft rotatable about said vertical axes of said first and said second centralizer housings;

(g) a cutter carriage housing having an upper end and a lower end, said cutter carriage housing oriented to extend vertically along its longitudinal axis, said upper end of said cutter carriage housing attached to said shaft of said hydraulic motor;

(h) a plurality of carriage plate support arms, each having first and second ends, said first ends of each of said carriage plate support arms pivotally attached to said upper end of cutter carriage housing;

(i) a carriage plate pivotally attached to said second ends of said carriage plate support arms;

(j) a cutter carriage hydraulic cylinder having an extendable and retractable piston rod, said cutter carriage hydraulic cylinder pivotally attached to said upper end of said cutter carriage housing and said piston rod of said cutter carriage hydraulic cylinder pivotally attached to said cutter plate support arms at a position above said carriage plate whereby said carriage plate is radially extendable and retractable from said cutter carriage housing by extension and retraction of said piston rod of said cutter carriage hydraulic cylinder;

(k) a hydraulic cutter mounted on said cutter swing carriage plate;

(l) a control system having monitors and sensors and information umbilicals generating information signals to a control panel; and (m) power, supply, or control umbilicals in communication with said control panel, said upper and said lower centralizer piston rod and cylinder mechanisms, said cutter carriage hydraulic cylinder, said hydraulic motor, and said hydraulic cutter.

12. The pile cutter recited in claim 11 further comprising:

(a) a nozzle configured with said hydraulic cutter whereby cutting fluid is ejected; and (b) a camera mounted upon said carriage plate, said camera generating images for delivery to said control panel.

13. The pile cutter recited in claim 12 wherein:

(a) said control system includes monitors and sensors generating information signals delivered to said control panel for processing whereby the rotational position of said hydraulic cutter about said longitudinal axis of said cutter carriage housing is thereby determined; and (b) wherein said hydraulic cutter is positioned within a hollow pile having a first end and a second end; and (c) wherein said control system generates information and control signals whereby the location of said hydraulic cutter with respect to said first end of said hollow pile is determinable and adjustable by a computer processor associated with said control system.

* * * * *